US011530875B2

(12) United States Patent
Galindo Perez et al.

(10) Patent No.: US 11,530,875 B2
(45) Date of Patent: Dec. 20, 2022

(54) COOKING APPLIANCE

(71) Applicant: BSH Hausgeräte GmbH, Munich (DE)

(72) Inventors: Juan Jose Galindo Perez, Saragossa (ES); Sergio Llorente Gil, Saragossa (ES); Dan Neumayer, Bernau (DE); Carlos Obon Abadia, Saragossa (ES); Enrique Javier Perez Visa, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 482 days.

(21) Appl. No.: 16/466,046

(22) PCT Filed: Dec. 12, 2017

(86) PCT No.: PCT/IB2017/057820
§ 371 (c)(1),
(2) Date: Jun. 3, 2019

(87) PCT Pub. No.: WO2018/116059
PCT Pub. Date: Jun. 28, 2018

(65) Prior Publication Data

US 2020/0033061 A1 Jan. 30, 2020

(30) Foreign Application Priority Data

Dec. 23, 2016 (ES) ..... ES201631676

(51) Int. Cl.

| | |
|---|---|
| ***H05B 6/10*** | (2006.01) |
| ***H05B 6/12*** | (2006.01) |
| ***F27B 5/14*** | (2006.01) |
| ***H05B 6/44*** | (2006.01) |

(52) U.S. Cl.
CPC ..... *F27B 5/14* (2013.01); *H05B 6/102* (2013.01); *H05B 6/129* (2013.01); *H05B 6/44* (2013.01); *H05B 2206/02* (2013.01)

(58) Field of Classification Search
CPC ..... F27B 5/14; H05B 2206/02; H05B 6/102; H05B 6/129; H05B 6/44
USPC ..... 219/620, 601, 622, 624, 634, 653, 656, 219/670, 675, 676, 680, 738, 699, 700, 219/701, 628, 629, 630; 99/DIG. 14, 451
See application file for complete search history.

(56) References Cited

U.S. PATENT DOCUMENTS

| | | | | |
|---|---|---|---|---|
| 6,147,336 | A | 11/2000 | Ushijima et al. | |
| 2004/0144773 | A1 | 7/2004 | Kim et al. | |
| 2017/0343221 | A1* | 11/2017 | Swayne | F24C 15/327 |

FOREIGN PATENT DOCUMENTS

| | | | |
|---|---|---|---|
| DE | 19853780 | A1 | 1/2000 |
| EP | 0291302 | A2 | 11/1988 |
| EP | 1130336 | A2 | 9/2001 |

(Continued)

OTHER PUBLICATIONS

International Search Report PCT/IB2017/057820 dated Mar. 20, 2018.
National Search Report ES P201631676 dated Dec. 11, 2017.

*Primary Examiner* — Quang T Van
(74) *Attorney, Agent, or Firm* — Michael E. Tschupp; Andre Pallapies; Brandon G. Braun

(57) ABSTRACT

A cooking appliance apparatus includes at least one fan unit having at least one fan wheel which is mounted for rotation about a rotation axis. A heating element is provided to heat the fan wheel in at least one operating state, with the heating element being configured as an induction heating element.

16 Claims, 2 Drawing Sheets

(56) References Cited

FOREIGN PATENT DOCUMENTS

| | | | | |
|---|---|---|---|---|
| JP | 56100241 | A | * | 8/1981 |
| WO | 2015155758 | A1 | | 10/2015 |

* cited by examiner

COOKING APPLIANCE

CROSS-REFERENCES TO RELATED APPLICATIONS

This application is the U.S. National Stage of International Application No. PCT/IB2017/057820, filed Dec. 12, 2017, which designated the United States and has been published as International Publication No. WO 2018/116059 A1 and which claims the priority of Spanish Patent Application, Serial No. P201631676, filed Dec. 23, 2016, pursuant to 35 U.S.C. 119(a)-(d).

BACKGROUND OF THE INVENTION

The invention relates to a cooking appliance apparatus and a method for operating a cooking appliance apparatus.

A cooking appliance apparatus with a fan unit is already known from the prior art. The fan unit has a fan wheel, which can be rotated about a rotation axis, and generates an air flow by means of the fan wheel in an operating state. The fan unit circulates air present in a cooking chamber by means of the generated air flow. A heating element of the cooking appliance apparatus is arranged on the fan wheel and fastened to the fan wheel in a mounted state. The heating element is attached to the fan wheel in the manner of a coating and is configured as a resistance heating element. Electricity is supplied to the heating element by way of an electrical connecting element, which supplies the heating element with electric current in an operating state.

BRIEF SUMMARY OF THE INVENTION

It is the object of the invention in particular to provide a generic apparatus with improved properties in respect of structure.

The invention is based on a cooking appliance apparatus, in particular an induction cooking appliance apparatus, advantageously an oven apparatus and preferably an induction oven apparatus, with at least one fan unit, which has at least one fan wheel, which can be rotated about a rotation axis, and which generates at least one air flow in particular by means of the fan wheel in at least one operating state, and with at least one heating element, which is provided to heat the fan wheel in at least one operating state.

It is proposed that the heating element is configured as an induction heating element. A "cooking appliance apparatus", in particular an "induction cooking appliance apparatus", advantageously an "oven apparatus" and preferably an "induction oven apparatus", refers in particular to at least a part, in particular a module, of a cooking appliance, in particular an induction cooking appliance, advantageously an oven and preferably an induction oven. In particular the cooking appliance apparatus has at least one muffle, within which at least a part of the fan unit, in particular the fan wheel, and in particular also the heating element and advantageously at least one appliance rear wall, are arranged in at least one mounted state. The muffle in particular delimits at least one cooking appliance interior at least partially and advantageously at least essentially together with at least one cooking appliance door. The muffle in particular delimits at least one cooking chamber at least partially and advantageously at least essentially together with at least one cooking appliance door and/or at least one cooking appliance rear wall. In particular the cooking chamber is arranged within the cooking appliance interior. A "fan unit" refers in particular to a unit with at least one fan wheel, which can be rotated about a rotation axis, which generates an air flow by means of the fan wheel in at least one operating state and circulates and/or sets into motion at least air present in a cooking chamber by means of the air flow. In particular the fan unit sucks air present in a cooking chamber by means of the fan wheel, in particular centrally and advantageously in proximity to the rotation axis, to the fan wheel and then blows the air sucked in away from the fan wheel, in particular at the edge, by means of the fan wheel. For example the fan unit could comprise at least one axial fan. Alternatively or additionally the fan unit could comprise at least one centrifugal fan, which could have in particular a larger heatable surface than an axial fan, thereby allowing a greater transfer of heat and/or a better performance to be achieved. A "rotation axis" refers in particular to an imagined straight line, about which the fan wheel is supported in a rotatable manner and which in particular runs at least essentially parallel to a fan shaft, which drives the fan wheel in a rotatable manner and about which the fan wheel rotates in particular in at least one operating state. "Essentially parallel" here refers in particular to an alignment of a direction relative to a reference direction, in particular in one plane, the direction having a deviation in particular less than 8°, advantageously less than 5° and particularly advantageously less than 2°, from the reference direction. A "fan wheel" refers in particular to an element supported in such a manner that it can be rotated about the rotation axis, which supplies work, in particular in the form of kinetic energy to air present in a cooking chamber in at least one operating state and/or which changes a direction of movement of air present in a cooking chamber in at least one operating state. In particular the fan wheel is made at least largely of at least one magnetic material, in particular at least one ferromagnetic material. The heating element has in particular at least one main function, which is heating the fan wheel. In particular in at least one mounted state the heating element is arranged in at least one position, which is suitable for heating the fan wheel and/or which allows and/or enables optimum heating of the fan wheel. For example in at least one mounted state the heating element could be arranged in proximity to the fan wheel, in particular avoiding direct contact. In particular the heating element could have at least one secondary function, in particular in addition to the main function, it being possible for said secondary function in particular to be heating at least one cooking chamber and/or at least one cooking appliance interior at least partially delimited by a muffle and/or at least one appliance rear wall and/or at least one muffle wall. The cooking appliance apparatus in particular has at least one electrical supply unit, which is provided in particular to supply electrical energy, in particular electric current, to the heating element. In particular the heating element is wound into at least one coil. For example the heating element could have at least two, in particular at least five, advantageously at least ten, particularly advantageously at least fifteen and preferably at least twenty, windings. The heating element in particular has at least one electrical conductor, which is wound in particular into a coil and in particular forms the windings of the heating element. The supply unit supplies the heating element with electrical energy in particular in at least one operating state. In at least one operating state the heating element generates in particular at least one electromagnetic alternating field. In particular the heating element generates Foucault's currents, in particular by means of the electromagnetic alternating field, in at least one, at least largely ferromagnetic, element, for example the fan wheel and/or at least one cooking appliance rear wall and/or at least one muffle wall. In at least one operating state the Foucault's currents generated by the heating element in the at least largely ferromagnetic element in particular result in the heating of the element due to at least one electrical resistance of the element. The element heated by the heating element in particular emits the heat to ambient air in at least one operating state. For example the fan wheel and/or at least one cooking appliance rear wall and/or at least one muffle wall could emit the heat to air sucked out of a cooking chamber in at least one operating state. In particular the fan wheel could blow the air sucked out of the cooking chamber back into the cooking chamber at least essentially simultaneously. There is then no need in particular for a resistance heating element, which reaches very high temperatures to heat air, as the fan wheel itself in particular becomes a heater, in particular a resistance heater, and heat is generated in particular in a surface of the fan wheel. Alternatively or additionally the at least largely ferromagnetic element could be heated in particular by means of remagnetization effects and/or remagnetization losses. "Provided" means in particular specifically programmed, designed and/or equipped. That an object is provided for a specific function means in particular that the object satisfies and/or performs said specific function in at least one application and/or operating state.

The inventive embodiment in particular allows structure to be improved. There is no need in particular for an electrical connection to a heating element present on the fan wheel, thereby simplifying structure and/or avoiding problems in respect of electrical cabling. Compared with a resistance heating element, a larger output is possible, in particular due to a larger heatable surface for transferring heat, in particular with a small temperature load on materials of the objects involved. It is possible in particular to avoid overheating and/or premature failure of the heating element. In particular the heating element can be operated in particular independently of operation of the fan and/or a durable embodiment can be provided.

It is further proposed that the heating element has at least one electrical conductor, which is configured as at least essentially rigid. In particular the conductor is made at least largely of at least one rigid material. For example the conductor could be made at least largely of copper. The conductor is advantageously made at least largely of iron and/or steel, thereby allowing in particular a low-cost and/or economically viable embodiment to be achieved. "Rigid" means in particular unmovable and/or stiff. In particular a distance between adjacent windings of the conductor relative to one another changes by maximum 1 mm, in particular maximum 0.1 mm, advantageously maximum 0.01 mm and preferably maximum 0.001 mm, further to the action of a force of at least 10 N, in particular at least 20 N, advantageously at least 50 N and preferably at least 100 N, on at least one of the adjacent windings. In at least one operating state electric current and advantageously an in particular high-frequency electric alternating current flows through the electrical conductor. This allows particularly good stability to be achieved in particular. There is no need in particular for a coil support, thereby reducing cost and/or allowing the conductor to be positioned flexibly in particular, as advantageously heated air flows can pass the conductor unimpeded.

It is also proposed that the conductor is at least partially wound at least essentially concentrically about the rotation axis. For example a portion in a range from 10% to 50%, in particular 20% to 40% and advantageously 25% to 35%, of a longitudinal extension of the conductor could be wound about the rotation axis. In particular a portion of at least 60%, in particular at least 70%, advantageously at least 80% and preferably at least 90%, of a longitudinal extension of the conductor is wound about the rotation axis. The supply unit is provided in particular to supply electricity to the heating element and in particular supplies the electrical conductor with electric current in at least one operating state. The cooking appliance apparatus in particular has at least one heating element connection, which connects the conductor and supply unit to one another in at least one mounted state. For example the heating element connection and the electrical conductor could be connected to one another at least essentially as a single piece. The heating element connection and the electrical conductor could in particular be formed from the same material. In particular the heating element connection has a longitudinal extension, which is different from a longitudinal extension of the conductor. A "longitudinal extension" of an object refers in particular to an extension of the object in an unwound state along a longitudinal extension direction of the object. A "longitudinal extension direction" of an object refers in particular to a direction aligned parallel to a longest side of a smallest imagined geometric cuboid, which still encloses the object completely when the object is unwound in one plane. An "extension" of an object refers in particular to a maximum distance between two points of a perpendicular projection of the object onto a plane. This allows regular heating of the fan wheel in particular.

It is further proposed that the conductor at least essentially at least partially encloses at least one partial region of the fan wheel at least when viewed along at least one direction perpendicular to the rotation axis. When viewed in the direction perpendicular to the rotation axis the conductor encloses the partial region of the fan wheel over an angle range of at least 180°, in particular at least 270°, advantageously at least 330° and preferably at least 350°, in relation to at least one geometric center of gravity and/or center point of the partial region. In particular at least one winding of the conductor has at least one first partial region and at least one second partial region, which are at a distance from one another in at least one axial direction, which is aligned in particular at least essentially parallel to the rotation axis. In particular at least one winding of the conductor has at least one first partial region and at least one second partial region, which are at a distance from one another in at least one vertical direction, which is aligned in particular at least essentially perpendicular to the rotation axis and in particular at least essentially perpendicular to a main extension plane of a muffle base. The expression "essentially perpendicular" here in particular defines an alignment of a direction relative to a reference direction, the direction and reference direction being at an angle of 90°, in particular when viewed in one plane, and the angle having a maximum deviation of in particular less than 8°, advantageously less than 5° and particularly advantageously less than 2°. A "main extension plane" of an object refers in particular to a plane, which is parallel to a largest side face of a smallest imagined geometric cuboid, which still encloses the object completely, and runs in particular through the center point of the cuboid. This in particular allows surfaces of the partial region opposite one another in a direction parallel to the rotation axis to be heated in a regular manner, thereby avoiding in particular thermal stresses within the partial region.

The conductor could be wound for example into a flat coil. For example windings of the conductor could be arranged in an, in particular single, plane. Windings of the conductor are preferably arranged in at least two, in particular in at least three, advantageously in at least four and preferably in at least five, different planes. Alternatively or additionally windings of the conductor could also be arranged for example in at least eight, in particular in at least ten, advantageously in at least fifteen and preferably in at least twenty, different planes. This allows a high level of flexibility and/or a high level of configuration freedom in particular to be achieved.

The different planes are in particular arranged at least essentially parallel to one another. For example the planes could be aligned at least essentially parallel to a muffle side wall and/or a muffle base. The different planes are preferably aligned at least essentially parallel to a muffle rear wall. In particular at least two windings of the conductor are at a distance from one another in at least one axial direction, which is aligned in particular at least essentially parallel to the rotation axis. In particular at least two windings of the conductor are arranged at a distance from one another in at least one radial direction, which is aligned in particular at least essentially perpendicular to the rotation axis. This allows a compact embodiment and/or deep insertion into the muffle compared with an embodiment, in which the different planes are aligned at least essentially perpendicular to a muffle rear wall.

It is also proposed that the conductor has a stepped configuration when viewed in a cross-sectional plane, which includes the rotation axis and is aligned in particular perpendicular to a muffle rear wall. When viewed in the cross-sectional plane there are in particular at least one first straight line, which connects at least two adjacent windings, and at least one second straight line, which connects at least two adjacent windings, which are different from the windings connected by the first straight line, and which is aligned in particular at least essentially perpendicular to the first straight line. This allows the fan wheel to be heated in particular from a number of sides and/or to be arranged at least partially within the conductor, allowing in particular particularly regular heating of the fan wheel.

It is further proposed that the cooking appliance apparatus has at least one cooking appliance rear wall, the heating element also being provided to heat the cooking appliance rear wall in the operating state. A "cooking appliance rear wall" refers in particular to a unit, which at least partially delimits a cooking chamber in at least one mounted state and which in particular has a main extension plane, which is aligned at least essentially parallel to a main extension plane of a muffle rear wall. In the operating state the heating element is provided in particular to heat the cooking appliance rear wall and the fan wheel at least essentially simultaneously and advantageously by means of the same electromagnetic alternating field. In particular the cooking appliance rear wall is made at least largely of at least one magnetic material, in particular at least one ferromagnetic material. In an alternative embodiment the cooking appliance rear wall could be made at least largely of at least one non-ferromagnetic material, thereby at least essentially preventing the cooking appliance rear wall being heated by the heating element. This in particular allows an electromagnetic alternating field generated by the heating element to be utilized optimally and/or allows particularly efficient and/or fast heating of a cooking chamber.

For example the heating element and fan wheel could be arranged at least essentially within a cooking chamber and/or in front of the cooking appliance rear wall when viewed from a front face. The heating element and fan wheel are preferably arranged behind the cooking appliance rear wall and in particular between the cooking appliance rear wall and a muffle rear wall, which in particular delimits a cooking appliance interior, when viewed from a front face. This in particular allows a well-protected arrangement of the heating element and fan wheel to be achieved. The efficiency of the heating element and fan unit system is in particular non-critical, as any conduction losses and/or heat emission, which can result in particular during operation of the heating element, take place within a cooking appliance interior and can therefore be used in particular to heat the cooking chamber.

A particularly high level of operating convenience can be provided in particular by a cooking appliance, in particular by an induction cooking appliance, advantageously by an oven and preferably by an induction oven, with at least one inventive cooking appliance apparatus, in particular with at least one inventive induction cooking appliance apparatus, advantageously with at least one inventive oven apparatus and preferably with at least one inventive induction oven apparatus.

Operating convenience can in particular be further enhanced by a method for operating an inventive cooking appliance apparatus, in particular an inventive induction cooking appliance apparatus, advantageously an inventive oven apparatus and preferably an inventive induction oven apparatus, with at least one fan unit, which has at least one fan wheel, which can be rotated about a rotation axis, and which generates at least one air flow by means of the fan wheel in particular in at least one operating state. It is proposed that the fan wheel is heated inductively in at least one operating state.

The cooking appliance apparatus here is not limited to the application and embodiment described above. In particular the cooking appliance apparatus can have a number of individual elements, components and units that is different from a number cited herein to bring about a mode of operation described herein.

Further advantages will emerge from the description of the drawings which follows. The drawing shows three exemplary embodiments of the invention. The drawing, description and claims contain numerous features in combination. The person skilled in the art will expediently also consider the features individually and combine them in further useful combinations.

DETAILED DESCRIPTION OF EXEMPLARY EMBODIMENTS OF THE PRESENT INVENTION

Figure 1:
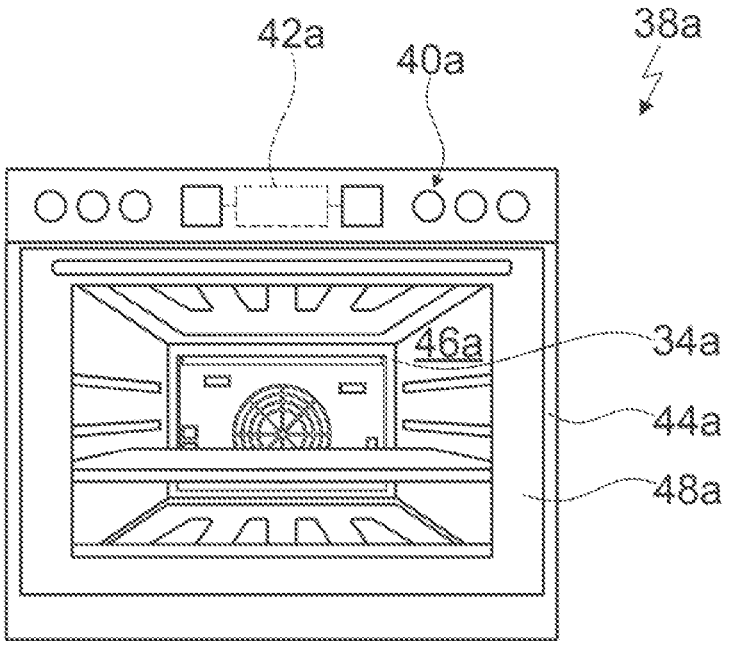
FIG. 1 shows a schematic view of a cooking appliance with a cooking appliance apparatus.

FIG. 1 shows a cooking appliance 38*a* with a cooking appliance apparatus 10*a*. The cooking appliance could be configured as a grill appliance and/or a microwave appliance for example. In the present exemplary embodiment the cooking appliance 38*a* is configured as an oven.

The cooking appliance apparatus 10*a* has a muffle 44*a*. The muffle 44*a* partially delimits a cooking appliance interior 46*a*. The muffle 44*a* essentially delimits the cooking appliance interior 46*a* together with a cooking appliance door 48*a*. The cooking appliance apparatus 10*a* comprises the cooking appliance door 48*a*.

The muffle 44*a* has a muffle base, a muffle top, two muffle side walls and a muffle rear wall 34*a*. The muffle base, the muffle top, the muffle side walls and the muffle rear wall 34*a*, together with the cooking appliance door 48*a*, essentially define the cooking appliance interior 46*a*.

Figure 2:
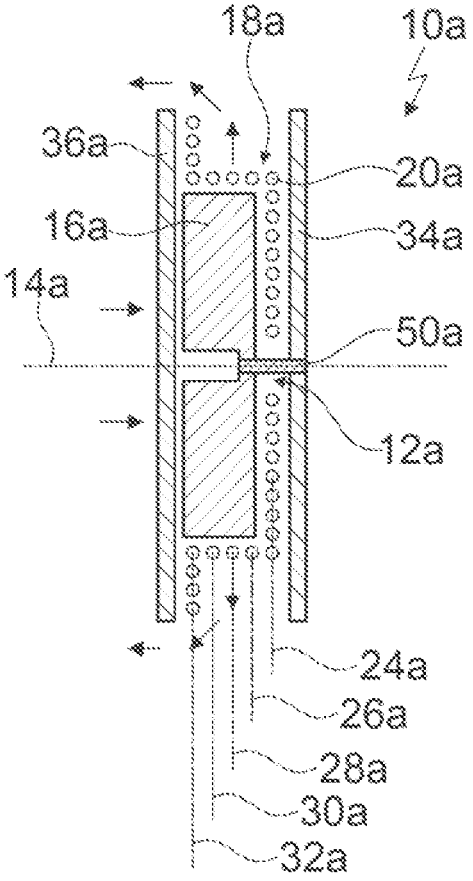
FIG. 2 shows a schematic sectional view of a fan unit, a heating element, a cooking appliance rear wall and a muffle rear wall of the cooking appliance apparatus.

The cooking appliance apparatus 10*a* has a fan unit 12*a* (see FIG. 2). The fan unit 12*a* has a fan wheel 16*a*, which can be rotated about a rotation axis 14*a*. The fan unit 12*a* generates an air flow by means of the fan wheel 16*a* in an operating state.

When viewed from a front face the fan unit 12*a* is arranged in a rear region of the cooking appliance interior 46*a*. The fan unit 12*a* is arranged in proximity to the muffle rear wall 34*a*.

The fan unit 12*a* has a fan shaft 50*a*. The fan shaft 50*a* couples the fan wheel 16*a* to the muffle rear wall 34*a*. The fan shaft 50*a* supports the fan wheel 16*a* in such a manner that it can be rotated relative to the muffle rear wall 34*a*. The rotation axis 14*a* runs essentially centrally through the fan shaft 50*a*. The fan shaft 50*a* essentially defines the rotation axis 14*a*.

The cooking appliance apparatus 10*a* has an operator interface 40*a* for inputting and/or selecting operating parameters, for example a heating power and/or a heating power density and/or a heating zone. The operator interface 40*a* is provided to output a value of an operating parameter to an operator.

The cooking appliance apparatus 10*a* has a control unit 42*a*. The control unit 42*a* is provided to perform actions and/or change settings as a function of operating parameters input by means of the operator interface 40*a*. In a heating operating state the control unit 42*a* regulates an energy supply to at least one heating element 18*a* (see FIG. 2).

The cooking appliance apparatus 10*a* has a heating element 18*a*. For example the cooking appliance apparatus could have at least one further heating element and in particular at least two, advantageously at least three, particularly advantageously at least five and preferably a number of, further heating elements, in particular in addition to the heating element. Only one of the further heating elements is described below. The further heating element could be provided for example to generate top heat and/or bottom heat and could be arranged in particular in proximity to a muffle top and/or a muffle base.

In the operating state the heating element 18*a* is provided to heat the fan wheel 16*a*. In the operating state the heating element 18*a* heats the fan wheel 16*a*. The heating element 18*a* is arranged in proximity to the fan wheel 16*a*.

In a method for operating the cooking appliance apparatus 10*a* the fan wheel 16*a* is heated inductively in the operating state. In the operating state the heating element 18*a* heats the fan wheel 16*a* inductively. The heating element 18*a* is configured as an induction heating element.

The heating element 18*a* has an electrical conductor 20*a* (see FIG. 2). The conductor 20*a* is configured as essentially rigid. The conductor 20*a* is wound into a coil. In the present exemplary embodiment the conductor 20*a* is partially wound essentially concentrically about the rotation axis 14*a*.

Windings of the conductor 20*a* are arranged in different planes 24*a*, 26*a*, 28*a*, 30*a*, 32*a*. In the present exemplary embodiment windings of the conductor 20*a* are arranged in five different planes 24*a*, 26*a*, 28*a*, 30*a*, 32*a*. The planes 24*a*, 26*a*, 28*a*, 30*a*, 32*a*, in which windings of the conductor 20*a* are arranged, are aligned essentially perpendicular to the rotation axis 14*a*. The planes 24*a*, 26*a*, 28*a*, 30*a*, 32*a*, in which windings of the conductor 20*a* are arranged, are arranged essentially parallel to the muffle rear wall 34*a*.

When viewed in a cross-sectional plane, which includes the rotation axis 14*a*, the conductor 20*a* has a stepped configuration. The conductor 20*a* has a stepped configuration from the rotation axis 14*a* in the cross-sectional plane. In the cross-sectional plane the conductor 20*a* is arranged essentially with mirror symmetry in relation to the rotation axis 14*a*. The stepped configuration of the conductor 20*a* allows it to form a holding region for holding the fan wheel 16*a*.

The heating element 18*a* heats the fan wheel 16*a* from a side region of the fan wheel 16*a* over essentially the entire circumference of the fan wheel 16*a* in the operating state. In the operating state the heating element 18*a* heats the fan wheel 16*a* from a rear face of the fan wheel 16*a*. In the operating state the heating element 18*a* also heats a cooking appliance rear wall 36*a*. In the operating state the heating element 18*a* is also provided to heat the cooking appliance rear wall 36*a*.

The cooking appliance apparatus 10*a* comprises the cooking appliance rear wall 36*a*. The cooking appliance rear wall 36*a* is arranged within the cooking appliance interior 46*a*. The cooking appliance rear wall 36 partially delimits a cooking chamber. The cooking appliance rear wall 36*a*, together with the muffle top, the muffle base, the muffle side walls and the cooking appliance door 48*a*, essentially delimits the cooking chamber. The cooking appliance rear wall 36*a* is arranged in front of the muffle rear wall 34*a* when viewed from a front face.

The heating element 18*a* and the fan wheel 16*a* are arranged behind the cooking appliance rear wall 36*a* when viewed from a front face. The heating element 18*a* and the fan wheel 16*a* are arranged between the cooking appliance rear wall 36*a* and the muffle rear wall 34*a* when viewed from a front face. In the present exemplary embodiment the fan wheel 16*a* is configured as an axial fan.

Figure 3:
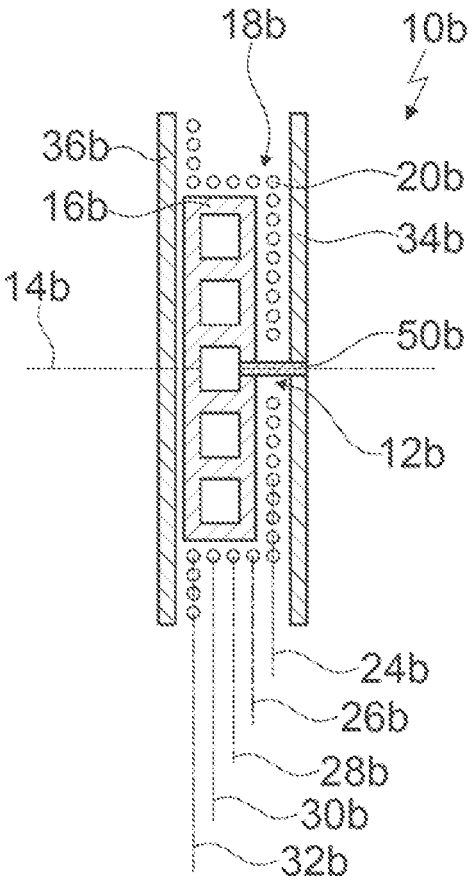
FIG. 3 shows a schematic sectional view of a fan unit, a heating element, a cooking appliance rear wall and a muffle rear wall of an alternative cooking appliance apparatus.
Figure 4:
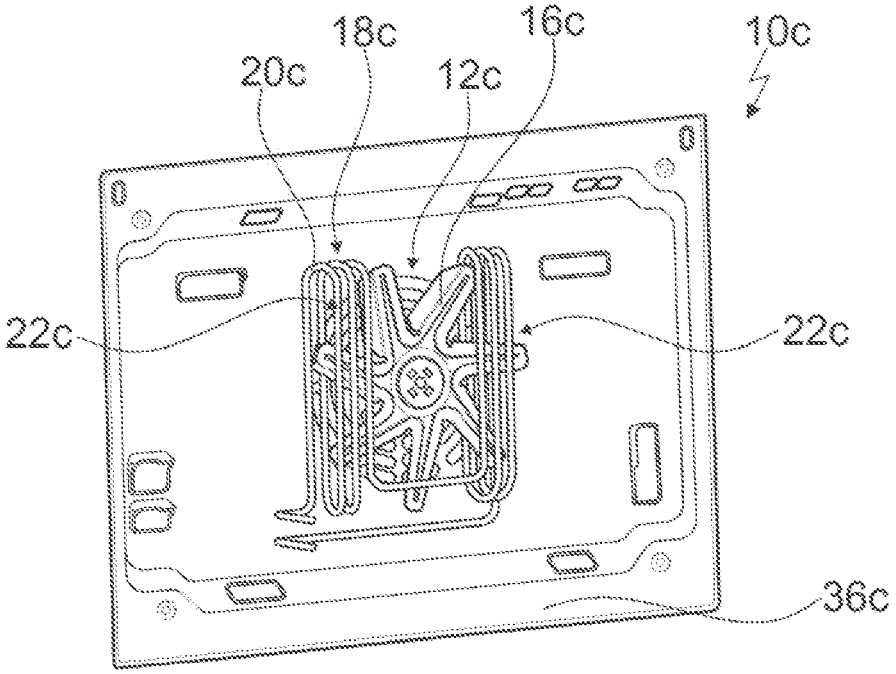
FIG. 4 shows a schematic view of a fan unit, a heating element and a cooking appliance rear wall of an alternative cooking appliance apparatus.

FIGS. 3 and 4 show two further exemplary embodiments of the invention. The descriptions which follow are limited essentially to the differences between the exemplary embodiments, it being possible to refer to the description of the exemplary embodiment in FIGS. 1 and 2 for components, features and functions that remain the same. To distinguish between the exemplary embodiments, the letter a in the reference characters of the exemplary embodiment in FIGS. 1 and 2 has been replaced by the letters b and c in the reference characters of the exemplary embodiments in FIGS. 3 and 4. It is possible in principle also to refer to the drawings and/or description of the exemplary embodiment in FIGS. 1 and 2 for components of identical designation, in particular for components with identical reference characters.

FIG. 3 shows a fan unit 12*b*, a heating element 18*b*, a cooking appliance rear wall 36*b* and a muffle rear wall 34*b* of an alternative cooking appliance apparatus 10*b*. The fan unit 12*b* has a fan wheel 16*b*, which can be rotated about a rotation axis 14*b*. In the present exemplary embodiment the fan wheel 16*b* is configured as a radial fan.

FIG. 4 shows a fan unit 12*c*, a heating element 18*c* and a cooking appliance rear wall 36*c* of an alternative cooking appliance apparatus 10*c*. The fan unit 12*c* has a fan wheel

16*c*, which can be rotated about a rotation axis 14*c*. The heating element 18*c* is provided to heat the fan wheel 16*c* in an operating state.

The heating element 18*c* has an electrical conductor 20*c* (see FIG. 2). The conductor 20*c* is configured as essentially rigid. The conductor 20*c* is wound into a coil. In the present exemplary embodiment the conductor 20*c* essentially partially encloses partial regions 22*c* of the fan wheel 16*c* when viewed along a direction perpendicular to the rotation axis 14*c*.

The invention claimed is:

1. A cooking appliance apparatus, comprising:

a fan unit including a fan wheel mounted for rotation about a rotation axis, the fan wheel having a side region and a rear face, the fan wheel generating at least one air flow when rotated about the rotation axis; and a heating element configured to heat the fan wheel in an operating state, the heating element forming a holding region for holding the fan wheel and enclosing a partial region of the fan wheel when viewed along a direction perpendicular to the rotation axis, said heating element being configured as an induction heating element to heat the fan wheel along both the side region and the rear face.

2. The cooking appliance apparatus of claim 1, wherein the heating element has an electrical conductor, which is configured substantially rigid.

3. The cooking appliance apparatus of claim 2, wherein the conductor is at least partially wound at least essentially concentrically about the rotation axis.

4. The cooking appliance apparatus of claim 2, wherein the conductor has windings arranged in at least two different planes, wherein a first plane of the two different planes is disposed above the rear face and a second plane of the two different planes is disposed along the side region.

5. The cooking appliance apparatus of claim 4, further comprising a muffle rear wall, wherein the different planes are aligned at least essentially parallel to the muffle rear wall.

6. The cooking appliance apparatus of claim 2, wherein the conductor has a stepped configuration when viewed in a cross-sectional plane, which includes the rotation axis.

7. The cooking appliance apparatus of claim 1, further comprising a cooking appliance rear wall, said heating element configured to heat the cooking appliance rear wall in the operating state.

8. The cooking appliance apparatus of claim 7, wherein the heating element and the fan wheel are arranged behind the cooking appliance rear wall when viewed from a front face.

9. A cooking appliance, comprising a cooking appliance apparatus, said cooking appliance apparatus comprising a fan unit including a fan wheel mounted for rotation about a rotation axis, the fan wheel having a side region and a rear face, the fan wheel generating at least one airflow when rotated about the rotation axis, and a heating element configured to heat the fan wheel in an operating state, the heating element forming a holding region for holding the fan wheel and enclosing a partial region of the fan wheel when viewed along a direction perpendicular to the rotation axis, said heating element being configured as an induction heating element to heat the fan wheel along both the side region and the rear face.

10. The cooking appliance of claim 9, wherein the heating element has an electrical conductor, which is configured substantially rigid.

11. The cooking appliance of claim 10, wherein the conductor is at least partially wound at least essentially concentrically about the rotation axis.

12. The cooking appliance of claim 10, wherein the conductor has windings arranged in at least two different planes, wherein a first plane of the two different planes is disposed above the rear face and a second plane of the two different planes is disposed along the side region.

13. The cooking appliance of claim 12, wherein the cooking appliance apparatus includes a muffle rear wall, wherein the different planes are aligned at least essentially parallel to the muffle rear wall.

14. The cooking appliance of claim 10, wherein the conductor has a stepped configuration when viewed in a cross-sectional plane, which includes the rotation axis.

15. The cooking appliance of claim 9, wherein the cooking appliance apparatus includes a cooking appliance rear wall, said heating element configured to heat the cooking appliance rear wall in the operating state.

16. The cooking appliance of claim 15, wherein the heating element and the fan wheel are arranged behind the cooking appliance rear wall when viewed from a front face.

* * * * *